US007052814B2

(12) United States Patent
Tanida

(10) Patent No.: US 7,052,814 B2
(45) Date of Patent: May 30, 2006

(54) TONER

(75) Inventor: Keiichi Tanida, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 185 days.

(21) Appl. No.: 10/693,454

(22) Filed: Oct. 27, 2003

(65) Prior Publication Data

US 2004/0091804 A1 May 13, 2004

(30) Foreign Application Priority Data

Oct. 29, 2002 (JP) ..... 2002-314653
Oct. 29, 2002 (JP) ..... 2002-314654

(51) Int. Cl.
*G03G 9/00* (2006.01)

(52) U.S. Cl. ..... 430/108.9; 430/109.1; 430/109.2; 430/109.3; 430/109.4; 430/111.4; 430/107.1

(58) Field of Classification Search ..... 430/108.9, 430/109.1, 109.2, 109.3, 109.4, 111.4, 107.1
See application file for complete search history.

(56) References Cited

U.S. PATENT DOCUMENTS 5,968,701 A * 10/1999 Onuma et al. ..... 430/108.22
6,500,594 B1 * 12/2002 Hamano et al. ..... 430/109.4

FOREIGN PATENT DOCUMENTS

JP 2001-296692 10/2001
JP 2001-296693 10/2001

* cited by examiner

*Primary Examiner*—Mark A. Chapman
(74) *Attorney, Agent, or Firm*—Smith Gambrell & Russell LLP

(57) ABSTRACT

A toner for use in an oil-less fixing system free from an oil coating on a fixing roller, the toner includes a binder resin and a wax as well as carbon black having an oil absorption of 50 to 100 mL/100 g where the toner is the black toner or a coloring agent where the toner is the color toner, and wherein the binder resin has a rate of decrease of storage elastic modulus G' of not more than 0.3 Pa/° C. as determined in association with temperature increase in the range of 160 to 200° C. The binder resin preferably has a weight average molecular weight [Mw] of 10,000 to 200,000, an [Mw/Mn] ratio between [Mw] and a number average molecular weight [Mn] thereof in the range of 1 to 15, or a peak rate of decrease of the storage elastic modulus G' in the temperature range of 70 to 100° C. The toner suited for use in the oil-less fixing system and particularly suitable for forming a color image is provided.

6 Claims, No Drawings

TONER

BACKGROUND OF THE INVENTION

The present invention relates to a toner for use in a developing process such as an electrophotographic process, electrostatic recording process and electrostatic printing process, and more particularly to a black toner or a color toner suitable for use in an oil-less fixing system.

In image forming apparatuses, such as copying machines and laser printers, which adopt the electrophotography, the electrostatic recording method or the electrostatic printing method, a toner is used as a developer for rendering an electrostatic latent image a visible image. In a step of fixing the resultant toner image onto a receiving material such as paper, generally adopted is a method wherein heat and/or pressure is applied to the toner image and a surface of the receiving material by means of a fixing roller (heat roller).

Since the fixing roller contacts the toner image in a molten state, the fixing roller is likely to encounter a so-called hot offset phenomenon wherein a part of the toner image is adhered or transferred to a surface of the fixing roller and re-transferred to another receiving material. The hot offset phenomenon leads to the contamination of formed images and hence, it is a general practice to carry out the fixing process with the fixing roller coated with oil for enhancing toner releasability from the fixing roller.

More recently, a technique for forming a color image such as a color copy has come into wide use, the technique wherein toner images of different colors are transferred and fixed to a single receiving material thereby forming a color image thereon. Unfortunately, a color image formed with color toners, in particular, tends to have a glossy image surface (so-called shine) which results from the oil adhered to the toner, the oil applied to the fixing roller surface. This makes it difficult to attain a satisfactory image quality of the color image. There is another problem that while recent years have seen an increasing demand for adding a retouch characteristic to the formed images, the retouch characteristic is impaired by the oil adhesion to the toner.

On this account, it is desired to adopt the so-called oil-less fixing system wherein the fixing roller is not coated with oil. In this case, however, the toner must be increased in the releasability from the fixing roller in order to prevent the hot offset phenomenon.

Conventionally, a method of admixing wax in toner particles in high concentrations has been adopted as means for increasing the releasability of the toner from the fixing roller (see Patent Documents 1 and 2). However, the method tends to encounter a phenomenon wherein the wax separates from the toner particles to adhere to carrier, thus entailing image degradation.

Patent Document 1: Japanese Unexamined Patent Publication No.2001-296692 (Paragraphs [0043] to [0044])

Patent Document 2: Japanese Unexamined Patent Publication No.2001-296693 (Paragraphs [0044] to [0045])

SUMMARY OF THE INVENTION

Therefore, a demand exists for a method of improving the releasability of the toner from the fixing roller while limiting the use of the wax. Hence, it is an object of the invention to provide a black toner and a color toner suitable for use in the oil-less fixing system or particularly suited for forming a color image. Hereinafter, the "toner" includes both the black toner and the color toner unless otherwise specified.

In an effort to solve the above problems, the present inventors have made intensive studies focusing attention to a high-temperature viscoelasticity of the toner. As a result, the inventors have found the following novel fact, based on which the invention has been accomplished. That is, the toner can be improved in the separating performance (releasability) from the fixing roller by conditioning a binder resin forming the toner, such that in a 160–200° C. temperature range (high temperature region) equivalent to general fixing temperatures in the image forming apparatuses, the binder resin has a smaller rate of decrease of storage elastic modulus G' (the degree of decrease of the storage elastic modulus G' in association with the increase of temperature) than a predetermined value. That is, the binder resin is conditioned to be decreased in the storage elastic modulus G' in a smaller degree than the predetermined value in association with the increase of the temperature. Furthermore, in the case of the black toner, carbon black used as a coloring agent is conditioned to have an oil absorption in a predetermined range. Such conditionings offer a toner excellent in releasability, obviating the admixing of a large amount of wax in the binder resin.

According to the invention, a toner consisting of either a black toner or a color toner for use in an oil-less fixing system free from an oil coating on a fixing roller, the toner comprises a binder resin and a wax as well as carbon black having an oil absorption in the range of 50 to 100 mL/100 g where the toner is the black toner, or a coloring agent where the toner is the color toner, and is characterized in that the binder resin has a rate of decrease of storage elastic modulus G' of not more than 0.3 Pa/° C. as determined in association with temperature increase in the range of 160 to 200° C.

The conventional toners do not give a particular consideration to the viscoelasticity of the binder resin in the high temperature region. Therefore, the binder resin commonly used in the art or particularly the binder resin used in the color toner is significantly decreased in the storage elastic modulus G' in the high temperature region. This leads to a problem that the toner is prone to become syrupy because of an extremely decreased viscosity thereof in the high temperature region.

In contrast, the toner of the invention can exhibit an excellent releasability because the binder resin has the rate of decrease of the storage elastic modulus G' limited to the range of not more than 0.3 Pa/° C. at temperatures of 160 to 200° C. (so-called high temperature region). Specifically, in the temperature rage of 160 to 200° C., the binder resin is decreased in the storage elastic modulus G' by not more than 0.3 Pa in association with 1° C. temperature increase.

According to the black toner of the invention, the oil absorption of the carbon black is limited to the range of 50 to 100 mL/100 g and hence, the carbon black is improved in compatibility with a low-molecular weight component of the binder resin or wax so that the carbon black is freely dispersed in the toner. Particularly, the binder resin used in the toner for forming color images contains a so-called hard (rigid) monomer component which hinders a pigment such as carbon black from being dispersed in the toner. However, the invention can overcome the poor dispersibility of carbon black because the oil absorption of the carbon black is limited to the predetermined range.

Accordingly, the toner of the invention has an excellent releasability from the fixing roller and is particularly suitable for use in the oil-less fixing system. Furthermore, the black toner of the invention is suited for forming the color image in the above system.

According to the invention, the storage elastic modulus G' means a parameter representing the rigidity of the binder resin. The storage elastic modulus G' is a real part of complex elastic modulus G* and is expressed as:

$$G^*=G'+iG''$$

where G" denotes a loss elastic modulus, and 'i' denotes an imaginary number $(-1)^{1/2}$. The complex elastic modulus G* is determined from a ratio $(\sigma_0/\epsilon_0)$ between the maximum stress $\sigma_0$ and the maximum strain $\epsilon_0$ produced in a viscoelastic material subjected to dynamic shear stress caused by vibrations of sinusoidal wave. The relationship between the storage elastic modulus G' and the loss elastic modulus G" is represented by the following expression:

$$\tan\delta=G''/G'$$

where δ denotes a loss angle representing a phase angle between the strain and the shear stress.

According to the invention, measurement conditions for the storage elastic modulus G' and the like are as follows: test frequency: 10 Hz, test temperature: 23° C., test vibrational amplitude: 25 μm, sample compressibility (thicknesswise): 12%, inter-chuck distance: 24 mm, dimensions of measurement sample: 8 mm×8 mm. A viscoelastic spectrometer (DVE-V4 Model) commercially available from Rheology Co. was used for measuring the storage elastic modulus G' and the like.

According to the invention, the oil absorption of carbon black means the amount (mL) of absorbed dibutyl phthalate (DBP) based on 100 g of carbon black as determined according to "9. DBP Absorption 9.2 A-Method" in JIS (Japanese Industrial Standard) K6217 "Test Method for Basic Performances of Carbon Black for Use in Rubber".

As a general method for conditioning the binder resin forming the toner such as to control the high-temperature rate of decrease of the storage elastic modulus G' in the above range, the binder resin may be increased in the molecular weight thereof. However, the binder resin increased in the molecular weight may entail a seriously deteriorated gloss of the resultant image.

For the purposes of properly suppressing the shine of the formed image, imparting an adequate retouch characteristic to the image and ensuring an adequate gloss of the color image, it is preferred not only to increase the molecular weight of the binder resin which is conditioned to have the high-temperature rate of decrease of the storage elastic modulus G' in the predetermined range, but also to sharpen the distribution of the molecular weight of the binder resin.

Specifically, according to the toner of the invention, the binder resin is preferably conditioned to have a weight average molecular weight [Mw] in the range of 10,000 to 200,000 and an [Mw]/[Mn] ratio between the weight average molecular weight [Mw] and the number average molecular weight [Mn] in the range of 1 to 15.

The binder resin is conditioned to have the weight average molecular weight in the aforesaid range and the [Mw]/[Mn] ratio between the weight average molecular weight and the number average molecular weight in the aforesaid range, whereby the toner can ensure that the formed image is properly decreased in shine while the color image maintains an adequate gloss, and that the formed image is imparted with an adequate retouch characteristic.

According to the toner of the invention, it is preferred from the viewpoint of further enhancing the heat resistance and storage stability of the toner that the binder resin has a rate of change of the storage elastic modulus G' peaking in the temperature range of 70 to 100° C.

The binder resin employed by the conventional toner has a tendency that the storage elastic modulus G' thereof declines sharply at relatively low temperatures (the rate of change presents a peak). However, the toner can be improved in the heat resistance and the storage stability by conditioning the binder resin such that the peak of the change of the storage elastic modulus G' does not appear before the temperature reaches a relatively high level of 70 to 100° C., or such that the storage elastic modulus G' does not fluctuate sharply before the temperature is raised to the relatively high level of 70 to 100° C.

According to the toner of the invention, the toner has high releasability from the fixing roller because the high-temperature viscoelasticity of the binder resin is limited to the predetermined range. Therefore, the toner preferably has a low wax content in the light of positively preventing the problem that the wax separates from the toner to adhere to the carrier. Specifically, it is preferred to limit the mixing ratio of the wax to not more than 10 parts by weight based on 100 parts by weight of binder resin.

According to the black toner of the invention, the binder resin is preferably polyester whereas the wax is preferably a Fischer-Tropsh wax. By using the above combination of the binder resin and the wax, the toner is improved in the fixing characteristic, chargeability and durability.

The black toner of the invention is not only suitable for use in the oil-less fixing system but also is particularly preferred as a toner for forming the color image. That is, the black toner of the invention is favorably used as a black toner used in combination with a common color toner of cyan, magenta, yellow or the like.

According to the color toner of the invention, the binder resin preferably comprises a styrene-acryl resin, a polyester resin, an epoxy resin or a phenol resin. As the binder resin, any of the above illustrative resins may be used alone or in combination with another resin as a copolymer or as a blend.

DETAILED DESCRIPTION OF THE INVENTION

Next, the toner of the invention will be described in details.

[Binder Resin]

A binder resin for use in the toner of the invention is preferably a thermoplastic resin from the viewpoint of imparting good fixing performance to the toner. However, a thermosetting resin may also be used so long as the resin contains a crosslinked portion in an amount (gel amount) of not more than 10 wt %, or more preferably of 0.1 to 10 wt % as determined by a Soxhlet extractor. The resin having a partially crosslinked structure may be used as the binder resin thereby even further enhancing the storage stability, shape retention and durability of the toner without decreasing the fixing performance thereof. Therefore, there is no need for exclusively using the thermoplastic resin as the binder resin. The binder resin may be admixed with a crosslinking agent or may contain some proportion of thermosetting resin.

Examples of a usable thermoplastic resin include styrene-acryl resins, polyester resins, polystyrene resins, polyamide resins and the like. Examples of a usable thermosetting resin include epoxy resins, phenol resins, urethane resins and the like. These resins may be used alone or in combination of two or more types. Among the above-illustrated resins, the styrene-acryl resins and polyester resins are particularly preferred as the binder resin.

The requirement for the binder resin employed by the invention is that the rate of decrease of the storage elastic modulus G' associated with temperature increase is not more than 0.3 Pa/° C. as determined in the temperature range (so-called high temperature region) of 160 to 200° C. That is, the binder resin must satisfy the requirement that the storage elastic modulus G' thereof be decreased by not more than 0.3 Pa in association with 1° C. temperature increase as determined in the temperature range of 160 to 200° C.

It is preferred that the rate of decrease of the storage elastic modulus G' of the binder resin as determined in the above temperature range is particularly limited to not more than 0.2 Pa/° C.

In order to control the high-temperature rate of decrease of the storage elastic modulus G' of the binder resin, the molecular weight of the binder resin is increased. In addition, there may be further taken a measure of conditioning a monomer constituting the binder resin such that a flexible part such as C—C bond is decreased to the minimum possible proportion while a rigid part such as aromatic ring is increased to the maximum possible proportion.

In this case, however, a fear exists that the processing of the binder resin may encounter hard kneading or pulverizing although the binder resin is increased in strength in the high temperature region. Hence, a grinding process following granulation requires double steps of crushing the resultant granules into coarse product and of finely pulverizing the coarse product.

As mentioned supra, it is preferred for the purposes of even further enhancing the heat resistance and storage stability of the toner that the binder resin employed by the invention is conditioned to have such a rate of change of the storage elastic modulus G' as to peak in the temperature range of 70 to 100° C. or more preferably of 70 to 85° C.

In order to control the rate of change of the storage elastic modulus G' to peak in the relatively higher temperature region of 70 to 100° C., the same method as that to condition the rate of decrease of the storage elastic modulus G' may be taken. That is, the binder resin may be increased in the molecular weight thereof or the monomer as the constituent of the binder resin may be so conditioned as to contain the flexible part such as C—C bond in the minimum possible proportion and the rigid part such as aromatic ring in the maximum possible proportion.

In the light of properly suppressing the so-called shine of the resultant image and adequately imparting the retouch characteristic thereto, as described above, the binder resin employed by the invention may preferably be conditioned to have a weight average molecular weight [Mw] in the range of 10,000 to 200,000 and an [Mw/Mn] ratio between the weight average molecular weight [Mw] and the number average molecular weight [Mn] in the range of 1 to 15.

Particularly in the above range, the [Mw] of the binder resin may preferably range from 20,000 to 150,000 or more preferably from 50,000 to 100,000. Particularly in the above range, the [Mw/Mn] ratio of the binder resin may preferably range from 1 to 12 or more preferably from 3 to 12.

[Wax]

The wax employed by the invention may be any of the various types of waxes conventionally used in the toner. Specific examples of the wax include aliphatic hydrocarbons, fatty acid metal salts, higher fatty acids, fatty esters and partially saponificated products thereof; silicone oil; various types of naturally occurring waxes; waxes produced from coal; and the like. The weight average molecular weight of the wax is more preferably in the range of 1,000 to 10,000.

Among the above illustrated waxes, particularly preferred in the invention is a so-called Fischer-Tropsh wax (such as commercially available from Schumann Sasol, South African Coal Oil Gas Corp., Ltd. under the tradename of "PARAFLINT") which is produced from coal using the Fischer-Tropsh process. The Fischer-Tropsh wax may be used in combination with a polyester resin or the like so as to improve the fixing performance, chargeability and durability of the toner. However, the wax may be required to mix in a small amount such as 0.5 parts by weight based on 100 parts by weight of binder resin.

As mentioned supra, the mixing ratio of the wax is defined as not more than 10 parts by weight based on 100 parts by weight of binder resin in consideration of the releasing effect of the added wax and the prevention of the separation of the added wax from the toner. Particularly in the above range, the wax may preferably be contained in an amount of less than 5 parts by weight or more preferably of 4.5 parts by weight or less.

According to the invention as described above, the high-temperature viscoelasticity of the binder resin is limited to the predetermined range such that the toner may inherently have an excellent releasability from the fixing roller. Therefore, the mixing ratio of the wax may be limited to an extremely small amount. It is preferred that the wax is used in the minimum possible amount in the above range because a fear exists that the wax used in excess may separate from the toner to adhere to the carrier.

[Carbon Black]

Where the toner of the invention is a black toner, the toner contains carbon black. The carbon black is conditioned to have the oil absorption in the range of 50 to 100 mL/100 g, as described above. If the oil absorption is below the above range, the carbon black is decreased in compatibility with the low-molecular weight component of the binder resin or the wax, so that the carbon black is poorly dispersed. Conversely, if the oil absorption exceeds the above range, the interaction between the carbon black and the low-molecular weight component of the binder resin or the wax is so strong that the carbon black is separated from a high-molecular weight component of the binder resin and is poorly dispersed in the resin. Particularly in the above range, the oil absorption of the carbon black may preferably range from 55 to 90 mL/100 g or more preferably from 60 to 80 mL/100 g.

[Coloring Agent]

Where the toner of the invention is a color toner, the toner contains a coloring agent. The coloring agent is not particularly limited and a variety of the known coloring agents for use in the toner are usable. Specifically, various types of dyes and pigments conventionally known in the art may be used. Specific examples of a usable coloring agent are mentioned below.

Coloring Agents for Yellow Toner:

Azo pigments such as C.I. pigment yellow—1, C.I. pigment yellow-5, C.I. pigment yellow-12, C.I. pigment yellow-15, C.I. pigment yellow-17, C.I. pigment yellow—180, C.I. pigment yellow-74, C.I. pigment yellow-4, C.I. pigment yellow-81, C.I. pigment yellow-97, C.I. pigment yellow-93 and the like; inorganic pigments such as yellow iron oxide, yellow ochre and the like; nitro dyes such as C.I. acid yellow-1; oil-soluble dyes such as C.I. solvent yellow-2, C.I.

solvent yellow-6, C.I. solvent yellow-14, C.I. solvent yellow-15, C.I. solvent yellow-19, C.I. solvent yellow-21 and the like. Benzine pigments such as C.I. pigment yellow-12 in the above pigments may be preferably used in color tone and the like.

Coloring agents for magenta toner:

C.I. pigment red 49, C.I. pigment red 57, C.I. pigment red 81, C.I. pigment red 122, C.I. pigment red 184, C.I. pigment red 238, C.I. solvent red 19, C.I. solvent red49, C.I. solvent red 52, C.I. basic red 10, C.I. disperse red 15 and the like. Quinacridone pigments such as C.I. pigment red 122 in the above pigments may be preferably used in color tone and the like.

Coloring Agents for Cyan Toner:

C.I. pigment blue-15, C.I. pigment blue-16, C.I. solvent blue-55, C.I. solvent blue-70, C.I. direct blue-25, C.I. direct blue-86 and the like. Copper phthalocyanine pigments such as C.I. pigment blue-15 in the above pigments may be preferably used in color tone and the like.

[Other Components]

The other components admixed in the binder resin together with the carbon black or coloring agent, and the wax include, for example, a charge control agent and various types of stabilizers.

As to the charge control agent, either a positive charge control agent or a negative charge control agent is used according to the electrification polarity of the toner. The charge control agents are not particularly limited and a variety of the known charge control agents for use in the toner are usable. While the mixing ratio of the charge control agent is not particularly limited, the amount of the charge control agent is in the range of not more than 10 parts by weight, preferably of 0.1 to 10 parts by weight or more preferably of 0.5 to 5 parts by weight based on 100 parts by weight of binder resin.

Another component externally added to the toner particles obtained by dispersing the coloring agent (or the carbon black), wax and the like in the binder resin includes, for example, a surfactant. The carrier and the surfactant are not particularly limited and a variety of the known carriers and surfactants are usable.

[Preparation of Toner]

The black toner of the invention may be prepared by forming a powder material (toner particles) by dispersing a coloring agent or black toner, as well as a wax and the like into the above illustrative binder resin and, as required, externally adding inorganic ultrafine particles, such as silica, alumina and titanium oxide, to the powder material. The above powder material (toner particles) may be prepared by a so-called milling process which includes the steps of preparing a pre-mixture by homogeneously blending the binder resin with the coloring agent, the wax and the other components in a dry blender, Henschel mixer, ball mill or the like; homogeneously melting and kneading the resultant pre-mixture in a milling apparatus such as a Banburry mixer, roll, single- or twin-screw extruder/kneader; cooling and grinding the resultant product; and, as required, classifying the resultant particles.

The size of the toner particles is not particularly limited but is normally in the range of 3 to 12 μm or preferably of 5 to 10 μm. In the case of a toner of smaller particle size directed to high quality images, the size of the toner particles may favorably be in the range of 4 to 8 μm.

The method of externally adding the surfactant to the toner particles or blending the toner particles with the carrier is not particularly limited. The external addition of the surfactant to the toner particles or the blending of the toner particles with the carrier may be carried out by any of the known methods.

EXAMPLES

[Preparation of Black Toner]

Example 1

A mixture containing 100 parts by weight of polyester resin (binder resin), 5 parts by weight of carbon black, 4 parts by weight of Fischer-Tropsh wax and 2 parts by weight of charge control agent (Product of Orient Chemical CO., P-51) was molten and kneaded in a twin-screw extruder/kneader. The resultant product was subjected to cooling, milling and classification and thus was obtained a powder material having an average particle size of 8.0 μm.

The used polyester resin had a weight average molecular weight [Mw] of 65,000; a number average molecular weight [Mn] of 7,150; an [Mw]/[Mn] ratio between these molecular weights at 9.1; and a rate of decrease of the storage elastic modulus G' at 0.25 Pa/° C. as determined in association with temperature increase in the range of 160 to 200° C. The rate of decrease of the storage elastic modulus G' peaked at 71° C. The used carbon black had an oil absorption of 74 mL/100 g. Used as the Fischer-Tropsh wax was a straight type C-105 (solidification point: 105° C.) of "PARAFLINT (R)" series commercially available from Schumann Sasol Corp., Ltd.

Subsequently, 2 wt % of titanium oxide and 0.5 wt % of silica ($SiO_2$) were externally added to the above powder material and were allowed to adhere to the surface of the above powder material by agitation mixing. Thus was obtained a black toner.

A two-component developer was prepared by blending together 5 parts by weight of the resultant black toner and 95 parts by weight of ferrite carrier.

Examples 2 to 7 and Comparative Example 1

The same procedure as in Example 1 was taken to prepare a powder material, a black toner and a two-component developer, respectively, except that a different type of polyester resin was used in each example.

Table 1 shows the respective weight average molecular weights [Mw], number average molecular weights [Mn], [Mw]/[Mn] ratios, rates of decrease of the storage elastic modulus G' (160 to 200° C.) and temperatures (° C.) associated with the peak rate of decrease of the storage elastic modulus G' with respect to the used polyester resins.

Examples 8 and 9 and Comparative Examples 2 and 3

The same procedure as in Example 1 was taken to prepare a powder material, a black toner and a two-component developer, respectively, except that a different type of carbon black was used in each example.

Table 2 shows the respective oil absorptions (100 mL/100 g) of the used carbon blacks.

Comparative Example 4

The same procedure as in Example 1 was taken to prepare a powder material, a black toner and a two-component developer except that the wax was used in an amount of 12 parts by weight.

[Testing on Printer]

An image formation test was conducted on the two-component developers prepared in the above examples and comparative examples, using a page printer commercially available from KYOCERA MITA CORPORATION wherein a fixing heat roller having a diameter of 40 mm was driven at a linear speed of 120 mm/sec. The test evaluated the physical properties of the toners of the developers.

The formed images were visually observed for evaluation of two items of fixing performance and hot offset resistance. The evaluation method and the evaluation criteria are as follows.

Fixing Performance

The fixing roller was heated to a fixing temperature set at 160° C. and then, the printer was turned off to allow the fixing roller to cool for 10 minutes in the normal environment (20° C., 65% RH). Subsequently, the printer was turned on to produce 5 prints of a fixing pattern solid image in a consecutive manner whereby measurement sample images were obtained. The surface of each of the printed images was rubbed back and forth 10 times with a brass weight (1 kg) wrapped in a cotton cloth. The densities of each print image before and after the rubbing operation were measured by means of a Macbeth reflection densitometer. A ratio between these densities was used as a fixing percentage (%) for evaluating the fixing performance of each toner according to the following criteria.

A: a high fixing percentage of 95% or more, representing quite excellent toner fixing performance;

B: a somewhat lower fixing percentage of 90% or more but less than 95%, representing a practically acceptable toner fixing performance; and C: a low fixing percentage of less than 90%, representing an unacceptable toner fixing performance.

Hot Offset Resistance

There were consecutively produced 10 prints of an offset pattern image with the fixing temperature set to 230° C. under the normal environment (20° C., 65% RH). The printed images were visually observed for evaluation of the hot offset resistance according to the following criteria.

A: no hot offset observed;

B: a certain degree of hot offset observed but practically negligible; and

C: noticeable hot offset observed and rejected.

The results are listed in the following Tables 1 to 3.

TABLE 1

| | Ex. | | C. Ex. | Ex. | | Ex. | | |
|---|---|---|---|---|---|---|---|---|
| | 1 | 2 | 1 | 3 | 4 | 5 | 6 | 7 |
| [Binder Resin] | | | | | | | | |
| [Mw] | 65,000 | 150,000 | 15,000 | 15,000 | 190,000 | 220,000 | 12,000 | 18,000 |
| | A+ | A | A− | A− | A− | B | A− | A− |
| [Mn] | 7,150 | 37,500 | 1,070 | 1,100 | 63,000 | 36,000 | 670 | 3,600 |
| [Mw]/[Mn] | 9.1 | 4.0 | 14.0 | 13.6 | 3.0 | 6.1 | 17.9 | 5.0 |
| | A+ | A+ | A− | A− | A+ | A+ | B | A+ |
| DR of G' 160–200° C. (Pa/° C.) | 0.25 | 0.15 | 0.35 | 0.28 | 0.14 | 0.11 | 0.25 | 0.25 |
| | A | A+ | C | A | A+ | A+ | A | A |
| Temperature at Peak DR of G' (° C.) | 71 | 74 | 71 | 71 | 71 | 86 | 71 | 62 |
| | A+ | A+ | A+ | A+ | A+ | A | A+ | B |
| [Carbon Black] | | | | | | | | |
| Oil Absorption (mL/100 g) | 74 | 74 | 74 | 74 | 74 | 74 | 74 | 74 |
| | A+ | A+ | A+ | A+ | A+ | A+ | A+ | A+ |
| [Properties of Toner] | | | | | | | | |
| Fixing % | A | A | A | A | A | B | B | A |
| Anti-offset | A | A | C | A | A | A | A | B |

Note:
"Mw" denotes 'weight average molecular weight', "Mn" denotes 'number average molecular weight', "DR of G'" denotes 'decrease rate of storage elastic modulus G', and Ex. And C. Ex. Denote Example and Comparative Example, respectively.

TABLE 2

| | Ex. | | | C. Ex. | |
|---|---|---|---|---|---|
| | 1 | 8 | 9 | 2 | 3 |
| [Binder Resin] | | | | | |
| [Mw] | 65,000 | 65,000 | 65,000 | 65,000 | 65,000 |
| | A+ | A+ | A+ | A+ | A+ |
| [Mn] | 7,150 | 7,150 | 7,150 | 7,150 | 7,150 |
| [Mw]/[Mn] | 9.1 | 9.1 | 9.1 | 9.1 | 9.1 |
| | A+ | A+ | A+ | A+ | A+ |
| DR of G' 160–200° C. (Pa/° C.) | 0.25 | 0.25 | 0.25 | 0.25 | 0.25 |
| | A | A | A | A | A |
| Temperature at Peak DR of G' (° C.) | 71 | 71 | 71 | 71 | 71 |
| | A+ | A+ | A+ | A+ | A+ |
| [Carbon Black] | | | | | |
| Oil Absorption (mL/100 g) | 74 | 53 | 95 | 49 | 110 |
| | A+ | A− | A− | C | C |

TABLE 2-continued

| | Ex. | | | C. Ex. | |
|---|---|---|---|---|---|
| | 1 | 8 | 9 | 2 | 3 |
| | | [Properties of Toner] | | | |
| Fixing % | A | A | A | C | C |
| Anti-offset | A | A | A | A | A |

TABLE 3

| | Ex. 1 | C. Ex. 4 |
|---|---|---|
| [Binder Resin] | | |
| [Mw] | 65,000<br>A+ | 65,000<br>A+ |
| [Mn] | 7,150 | 7,150 |
| [mw]/[Mn] | 9.1<br>A+ | 9.1<br>A+ |
| DR of G' 160–200° C. (Pa/° C.) | 0.25<br>A | 0.25<br>A |
| Temperature at Peak DR of G' (° C.) | 71<br>A+ | 71<br>A+ |
| [Carbon Black] | | |
| Oil Absorption (mL/100 g) | 74<br>A+ | 74<br>A+ |
| [Compositions of Powdery Toner] unit: parts by weight | | |
| Binder resin | 100 | 100 |
| Carbon Black | 5 | 5 |
| Wax | 4 | 12 |
| Charge Control Agent | 2 | 2 |
| [Properties of Toner] | | |
| Fixing % | A | A |
| Anti-offset | A | C |

In Tables 1 to 3, the symbols accompanying the numerals representing [Mw], [Mn], [Mw/Mn], the rate of decrease of G' and the temperature associated with the peak rate of decrease of G' with respect to the polyester resin, or representing the oil absorption of carbon black mean as follows:

$A^+$: quite excellent;

A: good;

$A^-$: satisfying the range of favorable values of the physical properties;

B: not satisfying the range of favorable values of the physical properties; and

C: reject

As apparent from Tables 1 to 3, where the toners were prepared with the binder resins conditioned to present the rate of decrease of the storage elastic modulus G' in the predetermined range, as determined in association with temperature increase, and with the carbon blacks conditioned to present the oil absorption in the predetermined range (Examples 1 to 9), all the resultant toners have achieved favorable fixing performances and releasabilities. A comparison between Examples 1 to 4 and Examples 5 to 7 shows that the fixing performance and releasability are even further improved by conditioning the binder resin to have the weight average molecular weight [Mw], the number average molecular weight [Mn], the [Mw/Mn] ratio between these molecular weights and the temperature associated with the peak rate of decrease of the storage elastic modulus G' in the respective predetermined ranges.

[Preparation of Color Toner]

Example 10

A mixture containing 100 parts by weight of polyester resin (binder resin), 5 parts by weight of coloring agent (C.I. pigment red 122), 4.5 parts by weight of naturally occurring ester-base wax and 2 parts by weight of charge control agent (Product of Orient Chemical Co., P-51), was molten and kneaded in a twin-screw extruder/kneader. The resultant product was subjected to cooling, milling and classification and thus was obtained a powder material having an average particle size of 8.0 μm.

The used polyester resin had a weight average molecular weight [Mw] of 65,000; a number average molecular weight [Mn] of 7,150; an [Mw]/[Mn] ratio between these molecular weights at 9.1; and a rate of decrease of the storage elastic modulus G' at 0.25 Pa/° C. as determined in association with temperature increase in the range of 160 to 200° C. The rate of decrease of the storage elastic modulus G' peaked at 71° C. Subsequently, 2 wt % of titanium oxide and 0.5 wt % of silica ($SiO_2$) were externally added to the above powder material and were allowed to adhere to the surface of the above powder material by agitation mixing. Thus was obtained a color toner.

A two-component developer was prepared by blending together 5 parts by weight of the resultant color toner and 95 parts by weight of ferrite carrier.

Examples 11 to 16 and Comparative Example 5

The same procedure as in Example 10 was taken to prepare a powder material, a color toner and a two-component developer, respectively, except that a different type of polyester resin was used in each example.

Table 4 shows the respective weight average molecular weights [Mw], number average molecular weights [Mn], [Mw]/[Mn] ratios, rates of decrease of the storage elastic modulus G' (160 to 200° C.) and temperatures (° C.) associated with the peak rate of decrease of the storage elastic modulus G' with respect to the used polyester resins.

Comparative Example 6

The same procedure as in Example 10 was taken to prepare a powder material, a color toner and a two-component developer except that the wax was used in an amount of 12 parts by weight.

Example 17

A mixture containing 100 parts by weight of styrene-acryl resin (binder resin), 5 parts by weight of coloring agent (C.I. pigment red 122), 8 parts by weight of Fischer-Tropsh wax and 2 parts by weight of charge control agent (Product of Orient Chemical Co., P-51) was molten and kneaded in a twin-screw extruder/kneader. The resultant product was subjected to cooling, milling and classification and thus was obtained a powder material having an average particle size of 8.0 μm.

The used styrene-acryl resin had a weight average molecular weight [Mw] of 65,000; a number average molecular weight [Mn] of 19,500; an [Mw]/[Mn] ratio between these molecular weights at 4.1; and a rate of decrease of the storage elastic modulus G' at 0.26 Pa/° C. as determined in association with temperature increase in the range of 160 to 200° C. The rate of decrease of the storage elastic modulus G' peaked at 72° C. Subsequently, a color toner and a two-component developer were prepared the same way as in Example 10, except that the above powder material was used.

Example 18

A mixture containing 100 parts by weight of a blend of a styrene-acryl resin and a polyester resin (binder resin), 5 parts by weight of coloring agent (C.I. pigment red 122), 8 parts by weight of Fischer-Tropsh wax and 2 parts by weight of charge control agent (Product of Orient Chemical Co., P-51) was molten and kneaded in a twin-screw extruder/kneader. The resultant product was subjected to cooling, milling and classification and thus was obtained a powder material having an average particle size of 8.0 μm.

The above binder resin was prepared by blending together the aforesaid styrene-acryl resin and the aforesaid polyester resin in a ratio (weight ratio) of 20:80. The blend had a weight average molecular weight [Mw] of 100,000; a number average molecular weight [Mn] of 16,500; an [Mw]/[Mn] ratio between these molecular weights at 6.1; and a rate of decrease of the storage elastic modulus G' at 0.24 Pa/° C. as determined in association with temperature increase in the range of 160 to 200° C. The rate of decrease of the storage elastic modulus G' peaked at 75° C. Subsequently, a color toner and a two-component developer were prepared the same way as in Example 10, except that the above powder material was used.

[Testing on Printer]

The two-component developers prepared in the above examples and comparative examples were each subjected to the aforementioned testing on printer for evaluation of the physical properties of the toners. The toners were evaluated for the two items of fixing performance and hot offset resistance by visually observing the formed images. The evaluation method and criteria are the same as those described above. The results are listed in Tables 4 and 5.

TABLE 5

| | | | EX. | |
|---|---|---|---|---|
| | Ex. 10 | C. Ex. 6 | 17 | 18 |
| [Binder Resin] | | | | |
| Type | Pes | Pes | St-Ac | St-Ac/Pes 20:80 |
| [Mw] | 65,000 | 65,000 | 80,000 | 100,000 |
| | A+ | A+ | A+ | A+ |
| [Mn] | 7,150 | 7,150 | 19,500 | 16,500 |
| [Mw]/[Mn] | 9.1 | 9.1 | 4.1 | 6.1 |
| | A+ | A+ | A+ | A+ |
| DR of G' | 0.25 | 0.25 | 0.26 | 0.24 |
| 160–200° C. (Pa/° C.) | A | A | A | A |
| Temperature at | 71 | 71 | 72 | 75 |
| Peak DR of G' (° C.) | A+ | A+ | A+ | A+ |
| [Wax] | | | | |
| Type | ester | ester | F-T | F-T |
| [Compositions of Toner] | | | | |
| Binder Resin | 100 | 100 | 100 | 100 |
| Coloring Agent | 5 | 5 | 5 | 5 |
| Wax | 4.5 | 12 | 8 | 6 |
| Charge Control Agent | 2 | 2 | 2 | 2 |
| [Properties of Toner] | | | | |
| Fixing % | A | A | A | A |
| Anti-offset | A | C | A | A |

In Tables 4 and 5, the symbols accompanying the numerals representing [Mw], [Mn], [Mw/Mn] ratio, the rate of decrease of G' and the temperature associated with the peak rate of decrease of G' with respect to the polyester resin mean the same as those of Tables 1 to 3.

In the 'Type of Binder Resin' section of Table 5, "Pes" denotes the polyester resin, "St-Ac" denotes the styrene-acryl resin and "St-Ac/Pes 20:80" denotes the blend of the polyester resin and the styrene-acryl resin in a ratio (weight ratio) of 20:80. In the 'Type of Wax' section, "ester" denotes the naturally occurring ester-base wax and "F-T" denotes the Fischer-Tropsh wax.

As apparent from Tables 4 and 5, where the color toners were prepared with the binder resins so conditioned as to present the rate of decrease of the storage elastic modulus G',

TABLE 4

| | Ex. | | C. Ex. | Ex. | | Ex. | | |
|---|---|---|---|---|---|---|---|---|
| | 10 | 11 | 5 | 12 | 13 | 14 | 15 | 16 |
| [Binder Resin] | | | | | | | | |
| [Mw] | 65,000 | 150,000 | 15,000 | 15,000 | 190,000 | 220,000 | 12,000 | 18,000 |
| | A+ | A | A− | A− | A− | B | A− | A− |
| [Mn] | 7,150 | 37,500 | 10,700 | 1,100 | 63,000 | 36,000 | 670 | 3,600 |
| [Mw]/[Mn] | 9.1 | 4.0 | 14.0 | 13.6 | 3.0 | 6.1 | 17.9 | 5.0 |
| | A+ | A+ | A− | A− | A+ | A+ | B | A+ |
| DR of G' | 0.25 | 0.15 | 0.35 | 0.28 | 0.14 | 0.11 | 0.25 | 0.25 |
| 160–200° C. (Pa/° C.) | A | A+ | C | A | A+ | A+ | A | A |
| Temperature at | 71 | 74 | 71 | 71 | 71 | 86 | 71 | 62 |
| Peak DR of G' (° C.) | A+ | A+ | A+ | A+ | A+ | A | A+ | B |
| [Properties of Toner] | | | | | | | | |
| Fixing % | A | A | A | A | A | B | B | A |
| Anti-offset | A | A | C | A | A | A | A | B |

associated with temperature increase, in the predetermined range (Examples 10 to 18), all the resultant toners have achieved favorable fixing performances and releasabilities.

A comparison between Examples 10 to 13 and Examples 14 to 17 shows that the fixing performance and releasability are even further improved by conditioning the binder resin to have the weight average molecular weight [Mw], the number average molecular weight [Mn], the [Mw/Mn] ratio between these molecular weights, and the temperature associated with the peak rate of decrease of the storage elastic modulus G' in the predetermined ranges.

The disclosures of Japanese Patent Application Serial No.2002-314653 filed on Oct. 29, 2002, and Japanese Patent Application Serial No. 2002-314654 filed on Oct. 29, 2002, are incorporated herein by reference.

What is claimed is:

1. A toner for use in an oil-less fixing system free from an oil coating on a fixing roller, the toner comprising:

a binder resin and a wax, as well as carbon black having an oil absorption of 50 to 100 mL/100 g where the toner is a black toner, or a binder resin and a wax as well as a coloring agent where the toner is a color toner, wherein said binder resin has a rate of decrease of storage elastic modulus G' of not more than 0.3 Pa/C as determined in association with temperature increase in the range of 160 to 200C and a weight average molecular weight [Mw] in the range of 10,000 to 200,000 and an [Mw/Mn] ratio between [Mw] and a number average molecular weight [Mn] of the binder resin in the range of 3 to 12.

2. A toner according to claim 1, wherein said binder resin has a peak rate of decrease of the storage elastic modulus G' in the temperature range of 70 to 100° C.

3. A toner according to claim 1, wherein a content of said wax is not more than 10 parts by weight based on 100 parts by weight of said binder resin.

4. A toner according to claim 1, wherein said toner is the black toner, said binder resin is a polyester resin, and said wax is a Fischer-Tropsh wax.

5. A toner according to claim 1, wherein said toner is the black toner and used for forming a color image.

6. A toner according to claim 1, wherein said toner is the color toner and said binder resin contains a styrene-acryl resin, polyester resin, epoxy resin or phenol resin.

* * * * *